United States Patent [19]

Maruta et al.

[11] Patent Number: 4,845,527

[45] Date of Patent: Jul. 4, 1989

[54] COPYING APPARATUS

[75] Inventors: Syuzi Maruta; Masazumi Ito; Tadashi Ohira, all of Toyokawa, Japan

[73] Assignee: Minolta Camera Co. Kabushiki Kaisha, Osaka, Japan

[21] Appl. No.: 55,592

[22] Filed: May 27, 1987

[30] Foreign Application Priority Data

May 29, 1986 [JP] Japan ..... 61-124496

[51] Int. Cl.[4] ..... G03G 21/00

[52] U.S. Cl. ..... 355/210; 355/313; 355/319; 355/244

[58] Field of Search ..... 355/3 R, 14 R, 14 SH, 355/3 SH, 24, 26

[56] References Cited

U.S. PATENT DOCUMENTS

| | | | |
|---|---|---|---|
| 4,017,170 | 4/1977 | Komori et al. | 355/3 R |
| 4,054,380 | 10/1977 | Donohue et al. | 355/14 R |
| 4,090,787 | 5/1978 | Hubbard et al. | 355/14 R |
| 4,123,155 | 10/1978 | Hubert | 355/26 |
| 4,222,660 | 9/1980 | Furuichi et al. | 355/14 R |
| 4,453,821 | 6/1984 | Smith | 355/14 R X |
| 4,537,497 | 8/1985 | Masuda | 355/24 X |
| 4,721,381 | 1/1988 | Matsuo | 355/14 R |

FOREIGN PATENT DOCUMENTS 6111761 1/1986 Japan .

*Primary Examiner*—Fred L. Braun

*Attorney, Agent, or Firm*—Price, Gess & Ubell

[57] ABSTRACT

A copying apparatus capable of performing a first copy operation and a second copy operation on a sheet of copy paper in a duplex copy mode or a composite copy mode, a first group of input copy conditions are set to a first predetermined state if the second copy operation does not start within a first predetermined period of time after the first copy operation, and a second group of input copy operations are set to a second predetermined state if the first copy operation of the subsequent cycle does not start within a second predetermined period of time after the second copy operation, the first predetermined period of time being longer than the second predetermined period of time.

20 Claims, 10 Drawing Sheets

COPYING APPARATUS

BACKGROUND OF THE INVENTION

1. Field of the Invention

The present invention relates to a copying apparatus and particularly to an improvement of an automatic resetting mechanism of a copying apparatus capable of setting selectively a duplex copy mode or a composite copy mode.

2. Description of the Prior Art

There has been proposed a copying apparatus capable of selecting a duplex copy mode or a composite copy mode to copy two original images on both faces or one face of a sheet of copy paper.

Such a copying apparatus has a mechanism called an intermediate tray unit so that a sheet of copy paper on which a first copy operation has been completed is temporarily stored in the intermediate tray unit and is fed therefrom for a second copy operation.

On the other hand, a copying apparatus using an automatic resetting mechanism has been proposed. This automatic resetting mechanism resets various modes to a standard mode (with conditions of a copying magnification being an equal scale, the number of copies being one, and a density being medium for example) if any key is not operated within a prescribed period of time after an end of a copy operation or after input by a mode setting key.

Generally, in a duplex (or composite) copy mode, a first document and a second document are used. First, an image of the first document is printed on a first face (or an area of the first face) of a sheet and then an image of the second document is printed on a second face (or the remaining area of the first face) of the sheet. Thus, it is necessary to change the first document for the second document during operation in the duplex (or composite) copy mode.

However, it sometimes happens that the set mode including the duplex copy mode (or the composite copy mode) returns to the standard mode because of a lapse of an automatic resetting period before setting of the second document after the copy operation of the first document. In such a case, it is necessary to set again the desired mode, which is troublesome. If copy operation is started without setting again the desired mode, copy is made in a wrong manner.

Under such circumstances, several proposals has been made. The U.S. Pat. No. 4,054,380 discloses a copying apparatus in which all the copy conditions are cleared if it is not operated within a predetermined period of time.

The U.S. Pat. No. 4,222,660 discloses a copying apparatus in which an operation mode is set to an initial mode at the time of turning on the power supply, or at the time when the subsequent operation is not started within a prescribed period of time after an end of copy operation, or at the time when the subsequent operation is not started within a prescribed period of time after input through key operation.

The U.S. Pat. No. 4,123,155 discloses a copying apparatus having a function of discharging sheets of copy paper existing in an intermediate tray without printing those sheets.

In addition, the U.S. Pat. No. 4,017,170 discloses a copying apparatus in which aftertreatment is applied to a photoconductive drum to cause the surface potential thereof to be uniform after completion of a copying process by rotating the photoconductive drum.

SUMMARY OF THE INVENTION

In view of the above mentioned prior art documents, a primary object of the present invention is to provide an improvement of an automatic resetting mechanism of a copying apparatus capable of setting a duplex copy mode or a composite copy mode.

According to an aspect of the present invention, a copying apparatus comprises: image forming means; mean for inputting a plurality of copy conditions; means for inputting a copy instruction; means for automatically setting the input plurality of copy conditions selectively to a predetermined state if a subsequent copy instruction is not inputted within a predetermined period of time after operation of the image forming means; and time setting means for setting the predetermined period of time suited for the input copy conditions.

According to another aspect of the present invention, a copying apparatus comprises: image forming means; paper feed means including a first paper feed portion and a second paper feed portion; sheet receiving means; means for inputting a plurality of copy conditions; means for inputting a copy instruction; copy control means for controlling a first copy operation responsive to the copy instruction for printing an image on a sheet fed from the first paper feed portion by the image forming means under the input copy conditions, thereby to store the sheet in the second paper feed portion and a second copy operation responsive to the subsequent copy instruction after the first copy operation for printing the sheet fed from the second paper feed portion by the image forming means under the input copy conditions, thereby to discharge the sheet to the sheet receiving means; and means for automatically setting the input plurality of copy conditions selectively to a predetermined state, by setting a first group of copy conditions to a predetermined state if a copy instruction for the second copy operation is not inputted within a first predetermined period of time after the first copy operation and by setting a second group of copy conditions to a predetermined state if a copy instruction for the first copy operation is not inputted within a second predetermined period of time after the second copy operation.

According to a further aspect of the present invention, a copying apparatus comprises: image forming means; paper feed means including a first paper feed portion and a second paper feed portion; sheet receiving means; means for inputting a plurality of copy conditions; means for inputting a copy instruction; copy control means for controlling a first copy mode responsive to a copy instruction for performing operation for printing a sheet fed from the first paper feed portion by the image forming means under the input copy conditions to discharge the sheet to the sheet receiving means, and for controlling a second copy mode for performing a first copy operation responsive to another copy instruction for printing a sheet fed from the first paper feed portion by the image forming means under the input copy conditions to store the sheet in the second paper feed portion and performing a second copy operation responsive to a further copy instruction after the first copy operation for printing a sheet fed from the second paper feed portion by the image forming means under the input copy conditions to discharge the sheet to the sheet receiving means; and means for automatically setting the input plurality of copy conditions selectively to a predetermined state, by selectively setting the plurality of copy conditions to a predetermined state if a copy instruction is not inputted within a first predetermined period of time after the operation of the first copy mode, or within a second predetermined period of time after the first copy operation of the second copy mode, or within a third predetermined period of time after the second copy operation of the second copy mode.

According to a further aspect of the present invention, a copy apparatus comprises: image forming means; paper feed means for feeding sheets of paper to the image forming means; sheet receiving means for receiving the sheets printed by the image forming means; sheet transport means for sending the printed sheets selectively to the paper feed means or to the sheet receiving means; manual input means for inputting a plurality of copy conditions; means for inputting a copy instruction; copy control means including first and second control means, the first control means being responsive to a copy instruction to print a sheet fed from the paper feed means by the image forming means under the input copy conditions, thereby to send the sheet to the sheet receiving means, and the second control means being responsive to a copy instruction to print a sheet fed from the paper feed means by the image forming means under the input copy conditions, thereby to send the sheet to the paper feed means; a first timer set at the end of a copy operation by the first control means; a second timer set at the end of a copy operation by the second control means, a set period of the second timer being longer than a set period of the first timer; and means for automatically setting the input plurality of copy conditions selectively to a predetermined state, by setting a first group of copy conditions to a predetermined state if a copy instruction is not inputted within the set period of the first timer and setting a second group of copy conditions to a predetermined state if a copy instruction is not inputted within the set period of the second timer.

According to a further aspect of the present invention, a copying apparatus comprises: image forming means including a photoconductive member; paper feed means for feeding sheets of paper to the image forming means; sheet receiving means for receiving the sheets of paper printed by the image forming means; sheet transport means for sending the printed sheets of paper selectively to the paper feed means or to the sheet receiving means; manual input means for inputting a plurality of copy conditions; means for inputting a copy instruction; copy control means including first and second control means, the first control means being responsive to a copy instruction to print a sheet fed from the paper feed means by the image forming means under the input copy conditions, thereby to send the sheet to the sheet receiving means, and the second control means being responsive to a copy instruction to print a sheet fed from the paper feed means by the image forming means under the input copy conditions, thereby to send the sheet to the paper feed means; a first timer set at the end of the copy operation by the first control means; a second timer set at the end of the copy operation by the second control means, a set period of time of the second timer being longer than a set period of time of the first timer; and means for applying aftertreatment to the photoconductive member to cause a surface potential of the photoconductive member to be uniform during operation of the first or second timer.

According to a still further aspect of the present invention, a copying apparatus comprises: image forming means including a photoconductive member; means for inputting a plurality of copy conditions; means for applying aftertreatment to the photoconductive member within a predetermined period of time after operation of the image forming means; and time setting means for setting the above mentioned predetermined period of time suited for the input copy conditions.

According to a still further aspect of the present invention, a copying apparatus comprises an: image forming means including a photoconductive member; paper feed means including a first paper feed portion and a second paper feed portion; sheet receiving means; means for inputting a plurality of copy conditions; means for inputting a copy instruction; copy control means for controlling a first copy mode for performing an operation responsive to a copy instruction for printing a sheet fed from the first paper feed portion by the image forming means under the input copy conditions, thereby to discharge the sheet to the sheet receiving means, and controlling a second copy mode for performing a first copy operation responsive to another copy instruction for printing a sheet fed from the first paper feed portion by the image forming means under the input copy conditions, thereby to store the sheet in the second paper feed portion, and a second copy operation responsive to a further copy instruction after the first copy operation for printing a sheet fed from the second paper feed portion by the image forming means under the input copy conditions, thereby to discharge the sheet to the sheet receiving means; means for applying aftertreatment to the photoconductive member to cause a surface potential thereof to be uniform within a predetermined period of time after operation of the image forming means; and time setting means for setting the above mentioned predetermined period of time suited for the input copy condition.

Thus, in a copying apparatus according to the present invention, a set period of the timer for automatic resetting after the first copy operation (copy of the first face or the first copy of the composite mode) is relatively long and as a result the mode is not immediately returned to the initial mode if setting of the second document takes time. Consequently, a copying apparatus of the present invention is easy to handle since it is not necessary to set the second document in a hurry.

These objects and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
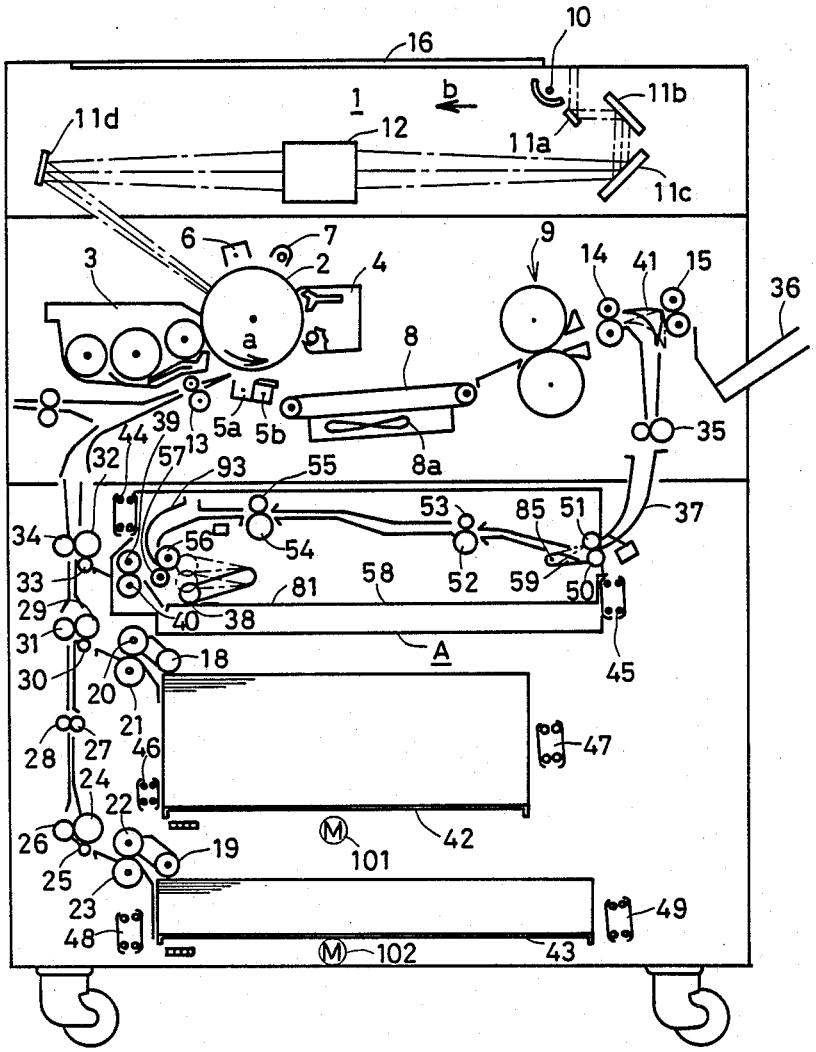
FIG. 1 is an illustration showing an outline of a mechanism of a copying apparatus of an embodiment of the present invention.

In the following, a copying apparatus of an embodiment of the present invention will be described with reference to the attached drawings.

First, referring to FIG. 1, construction and operation of this copying apparatus will be described. This copying apparatus includes a copy paper storing portions 42 and 43, and an intermediate tray unit A in a lower portion thereof, an image forming portion including a photoconductive drum 2 as a center in an intermediate portion thereof, and an optical system 1 in an upper portion thereof. When a sheet of copy paper onto which a first copy operation has been effected is fed again to the intermediate tray unit A, duplex copy (namely, copy of both faces of a sheet) or composite copy can be effected.

The photoconductive drum 2 is rotatable in a direction of the arrow a and, around the photoconductive drum 2, there are provided a sensitizing charger 6, a developing unit 3 of a magnetic brush type, a transfer charger 5*a*, a separation charger 5*b*, a cleaner 4 of a blade type, and an eraser lamp 7. When the photoconductive drum 2 rotates in the direction of the arrow a, it is uniformly sensitized by the sensitizing charger 6 and undergoes an exposure from the optical system 1 so that a latent electrostatic image is formed. This latent electrostatic image is developed by the developing unit 3 so that a toner image is obtained.

The optical system 1 is capable of scanning a document in a direction of the arrow b under a document glass table 16. The optical system 1 comprises an exposure lamp 10, movable mirrors 11*a*, 11*b* and 11*c*, a lens 12 and a fixed mirror 11*d*. The exposure lamp 10 and the movable mirror 11*a* move together in the direction of the arrow b at a speed V/m (m=a copying magnification) with respect to a rotation speed V of the photoconductive drum 2 (constant irrespective of whether an equal-scale magnification or a variable-scale magnification is selected), and the movable mirrors 11*b* and 11*c* move together in the direction of the arrow b at a speed V/2m.

Additionally, the copy paper storing portions comprise the upper elevator-type storing portion 42 and the lower elevator-type storing portion 43. The storing portions 42 and 43 are driven by an upper paper feed elevator lift-up motor 101 and lower paper feed elevator lift-up motor 102, respectively, so that sheets of copy paper contained therein are pushed upward when the sheets of copy paper are being fed. The storing portions 42 and 43 can be taken out in a direction from the main body of the copying apparatus to the front face thereof by means of rails 46 and 47, and rails 48 and 49, respectively.

Either the sheets of copy paper in the storing portion 42 or the sheets of copy paper in the storing portion 43 are delivered one by one selectively through delivery rollers 20 and 21 or delivery rollers 22 and 23 by rotation of a paper feed roller 18 or a paper feed roller 19 so as to be transported to timing rollers 13 through transport rollers 29, 30 and 31, and rollers 32 and 34 (in the case of the sheets in the storing portion 42) or through transport rollers 24, 25 and 26, and rollers 27 and 28 (in the case of the sheets in the storing portion 43).

The transported sheet is temporarily stopped by the timing rollers 13 and then it is sent out to a transfer portion in synchronism with the image formed on the photoconductive drum 2. Consequently, the above mentioned toner image is transferred onto the sheet by discharge of the transfer charger 5*a* and the sheet is separated from the surface of the photoconductive drum 2 by discharge of the separation charger 5*b*. Then, the sheet is transported to a fixing device 9 by means of a transport belt 8 comprising an air suction means 8*a* so that a fusing and fixing process is applied to the toner image.

A lever 41 for selecting a transport path of the copy paper is provided between transport rollers 14 adjacent to an outlet of the fixing device 9 and outlet rollers 15. If the sheet is to be readily discharged, the lever 41 is set in a position as shown by the chained lines in FIG. 1 so that the sheet sent out from the fixing device 9 is discharged from the outlet rollers 15 onto a tray 36. In the case of duplex copy or composite copy (to be described in detail afterwards), the lever 41 is set in a position shown by the solid lines so that the sheet is sent from transport rollers 35 through a guide plate 37 into the intermediate tray unit A to be described below in detail.

On the other hand, the cleaner 4 removes the remaining toner from the photoconductive drum 2 after the transfer and the remaining electric charge is removed by applying light from the eraser lamp 7 to the drum 2 so that the drum 2 is prepared for the subsequent copy operation.

Now, an outline of construction of the intermediate tray unit A will be described.

The intermediate tray unit A is formed as a unitary body comprising a selection block, a transfer block, a reverse block, an intermediate tray block and a re-feed block. Both ends of the unit A are supported by the rails 44 and 45. This unit A can be taken out from the main body of the copying apparatus in the direction of the front face, namely, in a direction perpendicular to a paper feeding direction.

The selection block has transport rollers 50 and 51, and a selection lever 59. The selection block may be provided in the main body of the copying apparatus not in the intermediate tray unit A.

The transport block comprises transport rollers 52, 53, 54 and 55, and a guide plate.

The reverse block comprises a reverse transfer rollers 56 and 57, and a reverse guide 93. This reverse block reverses the moving direction of the copy paper transported by the transport block to send it onto an intermediate tray 58.

The re-feed block comprises a holder, rollers 38, 39 and 40, and a guide plate. This re-feed block feeds again the sheets of copy paper on the intermediate tray 58 one by one for copy operation.

For the purpose of performing duplex copy or composite copy, either a mode selection key 303 or a mode selection key 304 on an operation panel 300 (shown in FIG. 2) is pressed to select either copy mode. Then, the selection lever 41 moves to be in the position shown by the solid lines in FIG. 1 so that the sheet of copy paper having one face or an area already printed is transported by the guide plate 37 from the transport rollers 35 to the transport rollers 50 and 51.

In the duplex copy mode, the selection lever 59 which may rotate around an axis 85 is set in a position shown by the solid lines in FIG. 1. As a result, the sheet of copy paper is moved over the upper surface of the lever 59 and sent to the transfer block and it is then transported through the guide plate to the left in FIG. 1 by the transport rollers 52, 53, 54 and 55. Then, it is turned by the reverse transport rollers 56 and 57, and the reverse guide 93 so that it is sent onto the intermediate tray 58 with the face already printed being directed upward. Then, the sheets thus transported are set in order so as to be fed again one by one by clockwise rotation of the re-feed roller 38.

On the other hand, in the composite copy mode, the selection lever 59 is set in a position shown by the chained lines in FIG. 1 so that the sheet of copy paper introduced by the transport rollers 50 and 51 is immediately guided along the lower surface of the lever 59 and is sent directly onto the intermediate tray 58 with the face already printed being directed downward. Then, in the same manner as in the duplex copy mode, the sheets of copy paper thus sent are fed again one by one by clockwise rotation of the re-feed roller 38.

The sheets of copy paper to be fed again are delivered through the delivery rollers 39 and 40 and transported to the timing rollers 13 through the transport rollers 32, 33 and 34, so that duplex copy or composite copy is applied to the sheets in the same manner as in the standard copy process. The re-feed roller 38 can be positioned at three levels (as shown by the chained lines, the dotted lines and the solid lines in FIG. 1). When the sheets of copy paper are sent onto the intermediate tray 58, the roller 38 is positioned at the upper or intermediate level and when the sheets of copy paper are fed again, it is positioned at the lowest level so as to press the sheets on the intermediate tray 58 by a suitable pressure.

Figure 2:
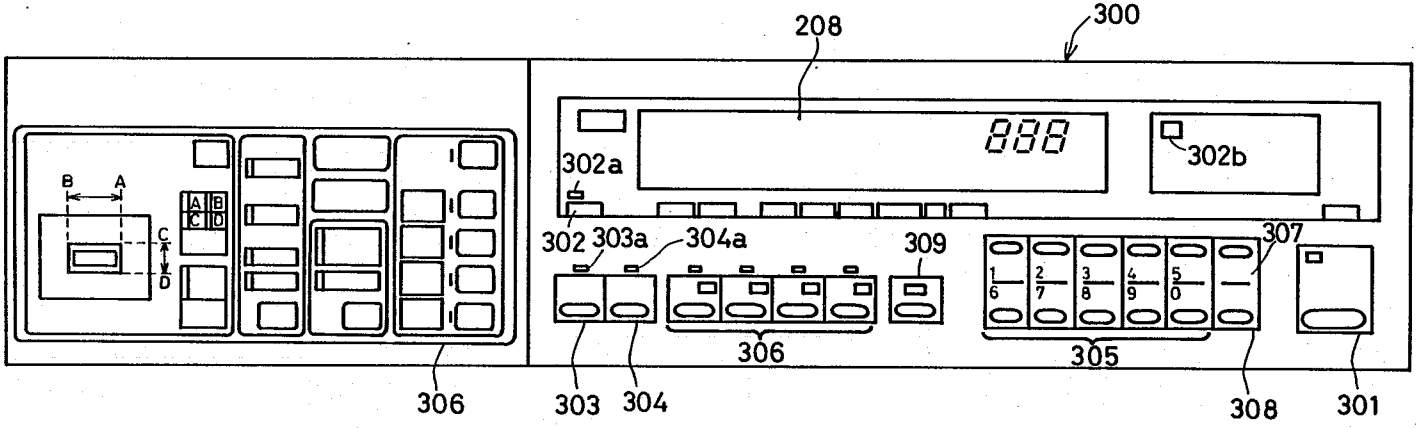
FIG. 2 is an illustration of an operation panel of the copying apparatus shown in FIG. 1.

FIG. 2 is an illustration showing the operation panel of the above described copying apparatus.

This operation panel comprises a print key 301, a paper size selection key 309, a magnification setting 306, a numerical value input ten key 305, an interruption key 307, a clear stop key 308, a duplex mode key 303 with a display element 303*a*, a composite mode key 304 with a display element 304*a*, a display portion 208, a standard feed mode 302 with a display element 302*a*, and an alarm display element 302*b* for displaying existence of remaining sheets in the intermediate tray, and the like.

Figure 3:
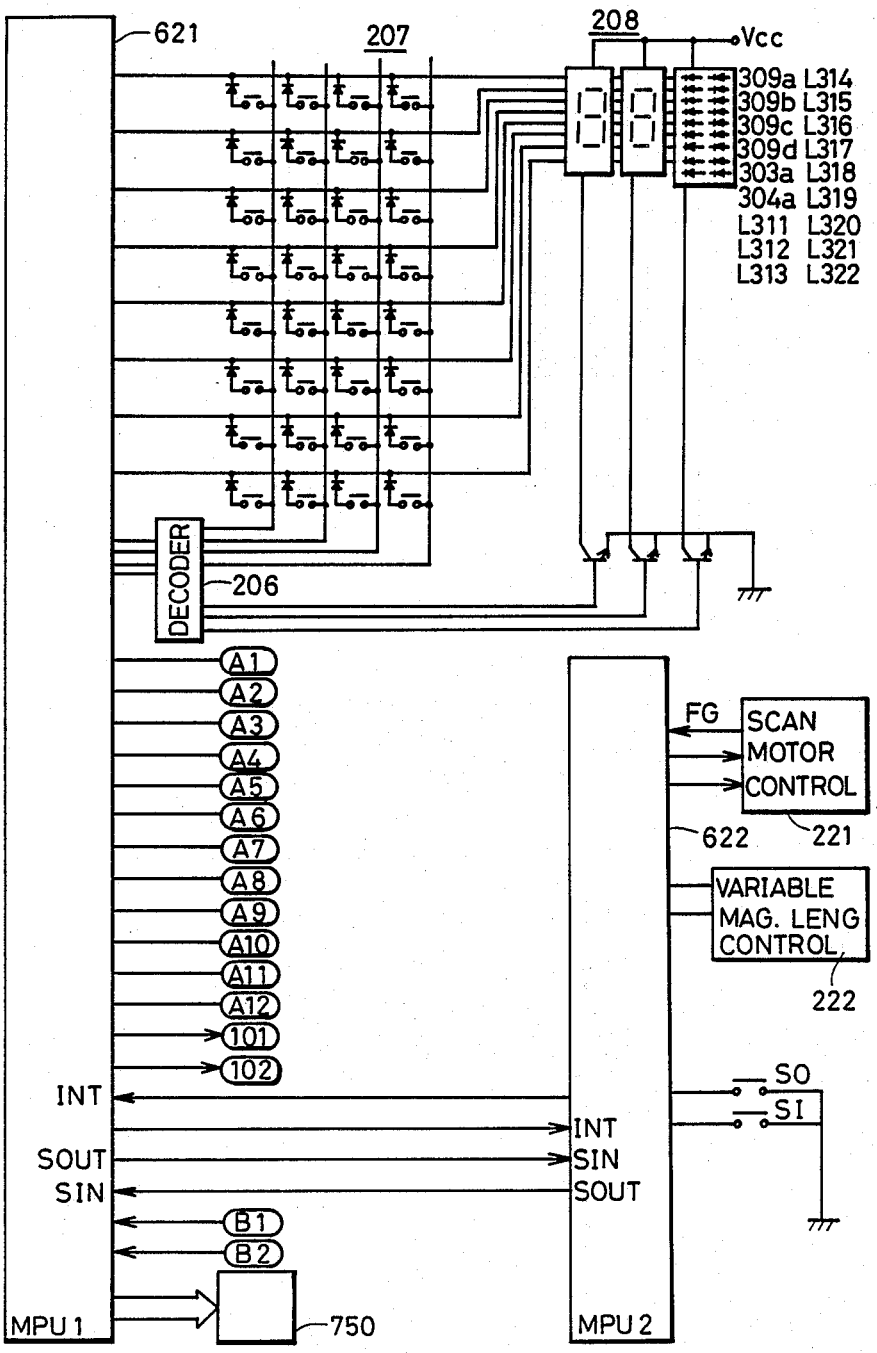
FIG. 3 is a circuit diagram showing an electric configuration of the copying apparatus shown in FIG. 1.

In the following, a control circuit of this copying apparatus will be described with reference to FIG. 3.

This control circuit mainly comprises a first microprocessing unit (MPU) 621 for control of copy operation and a second MPU 622 for control of the optical system, those MPUs 621 and 622 being connected with each other to be in synchronism. The first MPU 621 is connected with a switch matrix 207 were the operation keys on the operation panel 300 and sensors are arranged.

Output terminals A1 to A12 of the first MPU 621 are connected with a main motor, a development motor, a feed clutch, a re-feed clutch, solenoids for selection of the levers 41 and 59, etc. Those components are turned on and off by control based on signals from the above mentioned switch matrix 207. Output terminals 101 and 102 of the first MPU 621 are connected with the elevator drive motors for the upper and lower storing portions 42 and 43. The first MPU 621 is further connected with various LEDs for the display portion 208 etc. through a decoder 206 so as to control turning on and off of those LEDs.

On the other hand, the second MPU 622 is connected with a drive control portion 221 for a DC motor for scanning of the optical system, a drive control portion 222 for stepping a motor for movement of the lens, a fixed position switch S0 of the optical system 1, a timing switch S1 etc.

Now, operation of the apparatus of this embodiment will be described.

Figure 4:
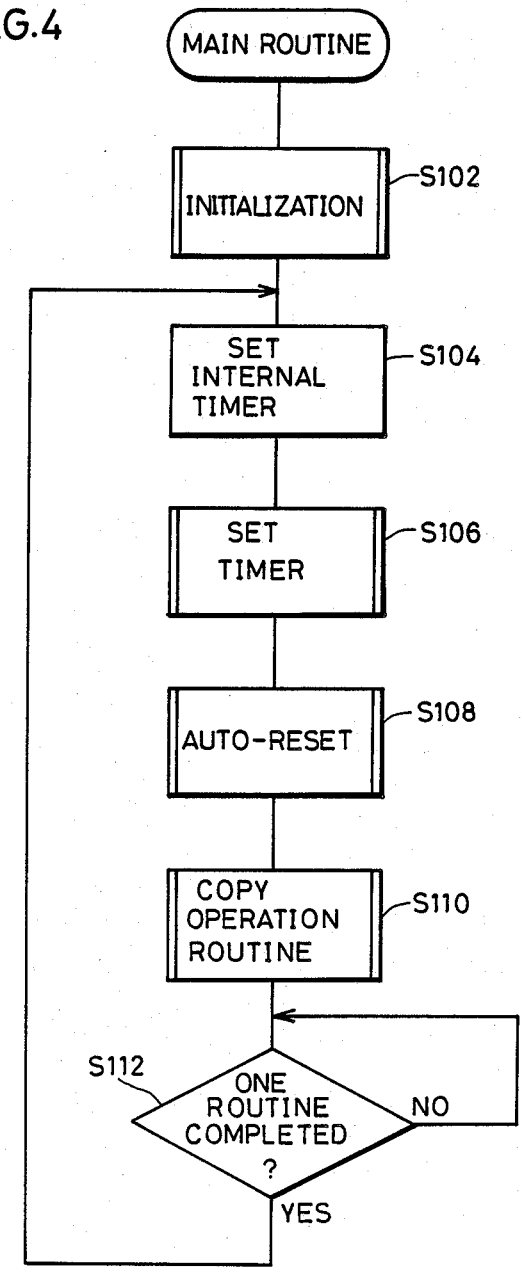
FIG. 4 is a flow chart showing a main routine of a first microprocessing unit of the copying apparatus shown in FIG. 1.

FIG. 4 is a flow chart showing a main routine of the first MPU 621 in the apparatus of this embodiment.

First, initialization is performed in the step S102. For example, a RAM, flags and the like are initialized and the copy mode is set to a first reference mode. The first reference mode is, for example, set to conditions in which copy of one face is selected, a magnification is 1, the number of copy sheets is 1 and the size of copy paper is A4.

Then, in the step S104, an internal timer for defining a length of time for one routine is set.

Subsequently, procedures in the steps S106 to S110 are executed. After that, there is a wait for an end of the internal timer set in the step S104 and then the routine returns to the step S104.

The step S106 is related with processing for setting an automatic resetting timer, which will be described below in detail with reference to FIG. 5.

The step S108 is related with automatic resetting processing, which will be described in detail with reference to FIG. 6.

The step S110 is related with copy operation processing, which will be described in detail with reference to FIG. 8.

Figure 5:
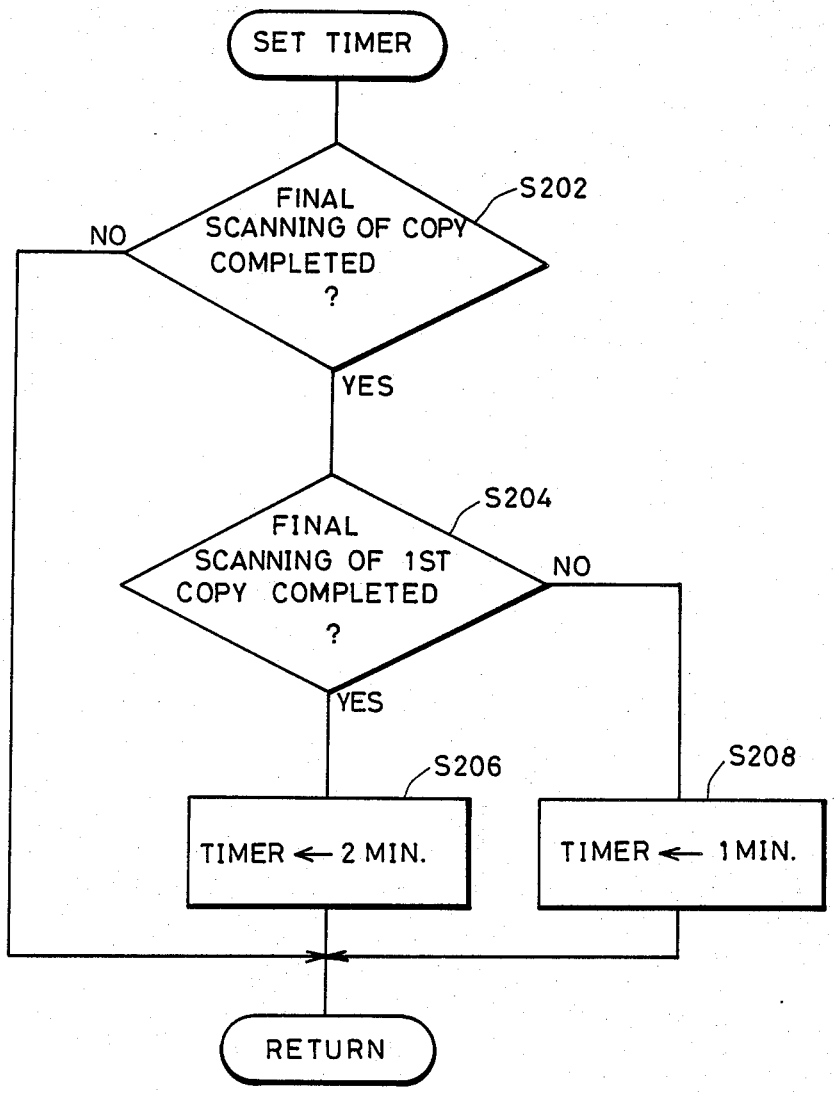
FIG. 5 is a flow chart showing the details of the step S106 shown in FIG. 4.

FIG. 5 is a flow chart for explaining the details of the step S106.

First, it is determined in the step S202 whether the final scanning of copy operation is completed or not. If it is not completed, the routine returns to the main routine.

If the final scanning is completed, the routine proceeds to the step S204 to determine whether the completed scanning is scanning of a first copy operation (a first copy operation in the duplex copy mode or the composite copy mode).

If it is the first copy operation, the routine proceeds to the step S206 to set two minutes for the automatic resetting timer.

If it is determined in the step S204 that it is not the first copy operation, the routine proceeds to the step S208 to set one minute for the automatic resetting timer.

Figure 6:
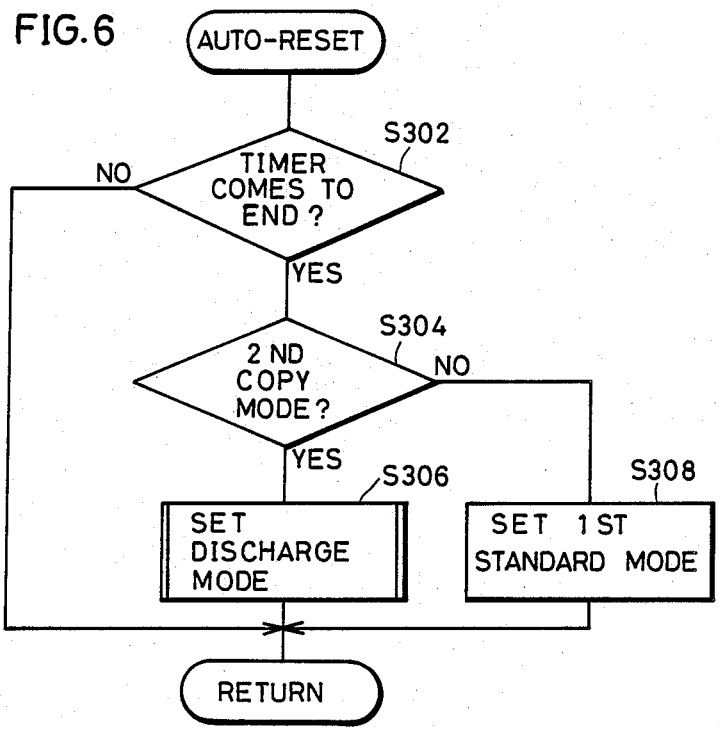
FIG. 6 is a flow chart showing the details of the step S108 shown in FIG. 4.

FIG. 6 is a flow chart showing the details of the step S108, auto-reset.

First, it is determined in the step S302 whether the automatic resetting timer set in the above described steps S206 or S208 shown in FIG. 5 comes to an end or not. If it does not come to an end, the routine returns to the main routine.

If it is determined in the step S302 that the above described timer comes to an end, the routine proceeds to the step S304 to determine whether the mode is a second copy mode (a second-face copy mode in duplex copy operation or a second copy mode in composite copy operation) or not. In other words, it is determined whether the apparatus is in a state ready for a second copy operation.

If it is determined in the step S304 that the second copy mode is selected, the program proceeds to the step S306 to set a second face discharge mode (a standard feed mode). This setting will be described in detail with reference to FIG. 7.

If it is determined in the step S304 that the second copy mode is not selected, the program proceeds to the step S308 to set the above described first reference mode.

Figure 7:
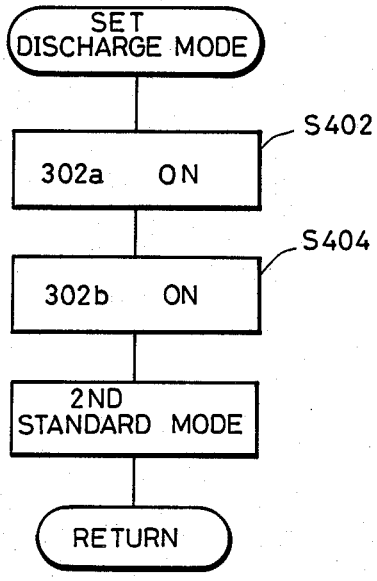
FIG. 7 is a flow chart showing the details of the step S306 shown in FIG. 6.
Figure 8A:
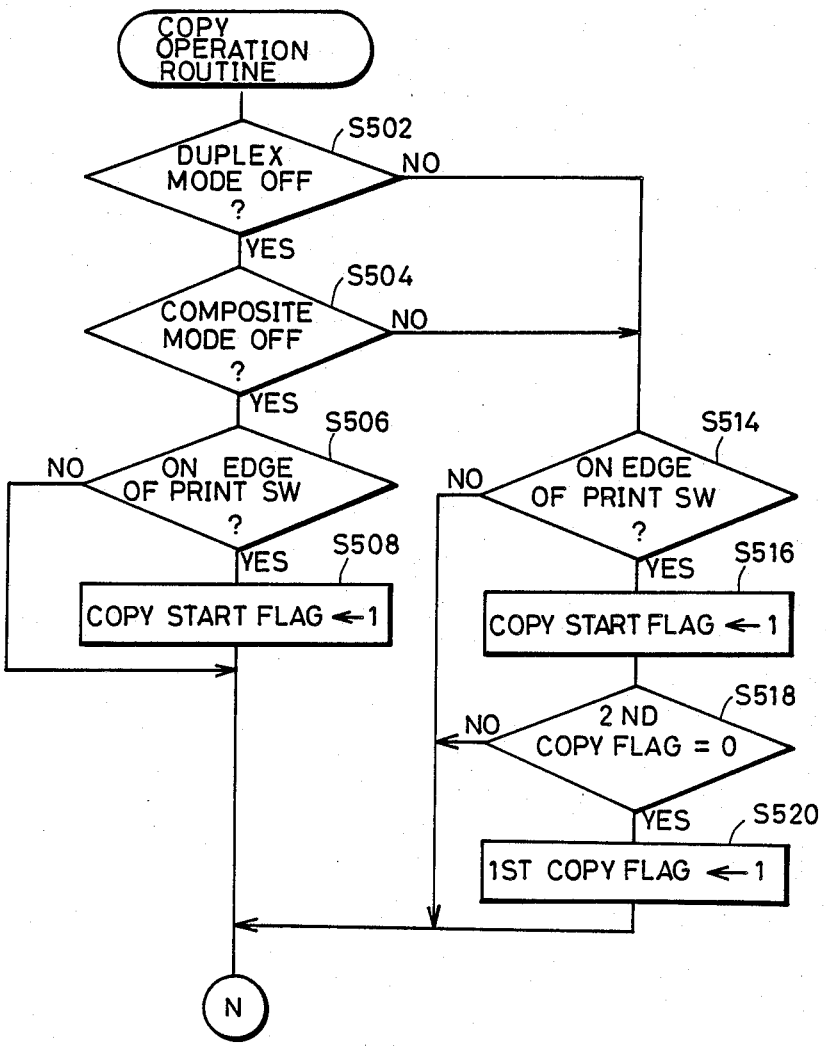
FIGS. 8A to 8D are flow charts showing the details of the processing of the step S110 shown in FIG. 4.
Figure 8B:
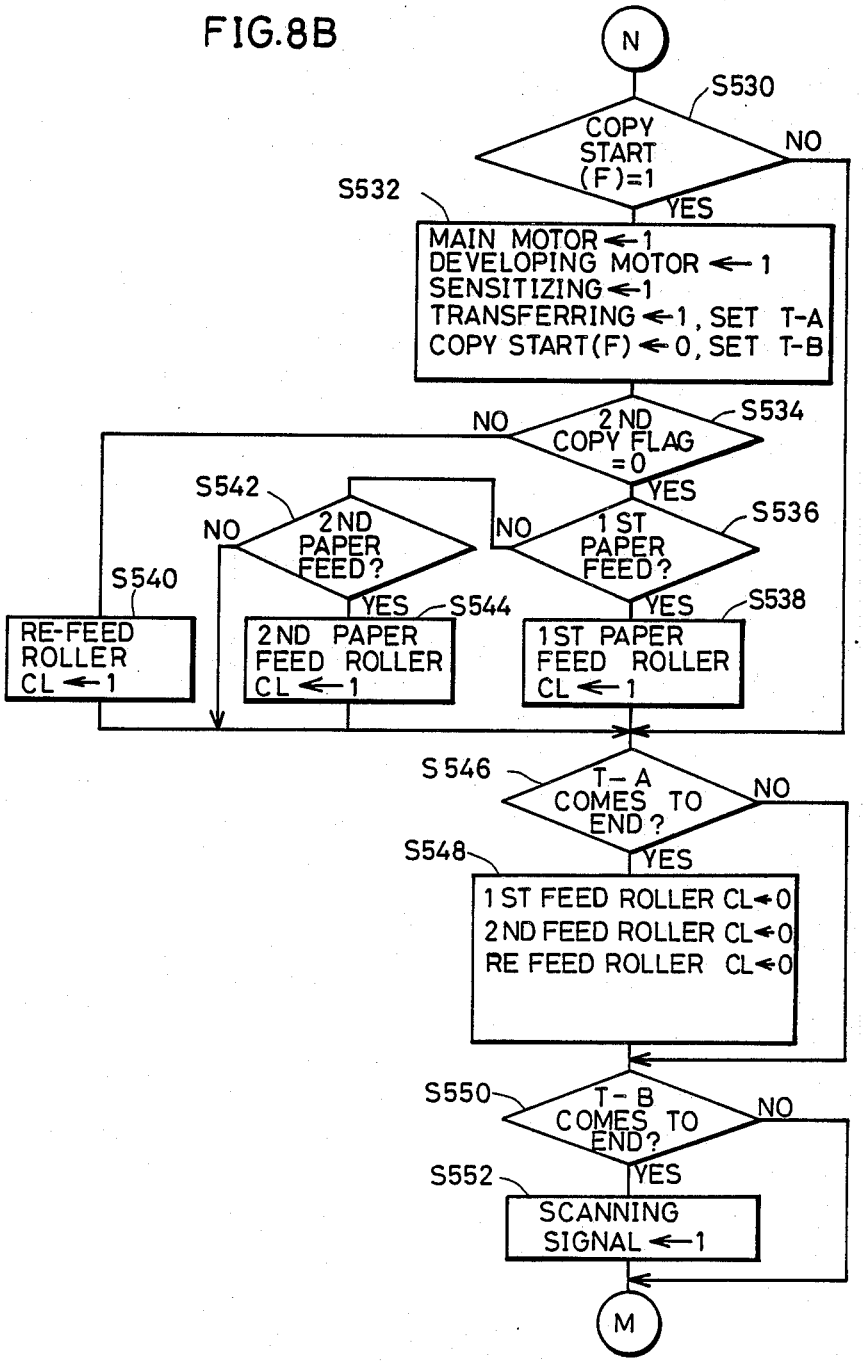
Figure 8C:
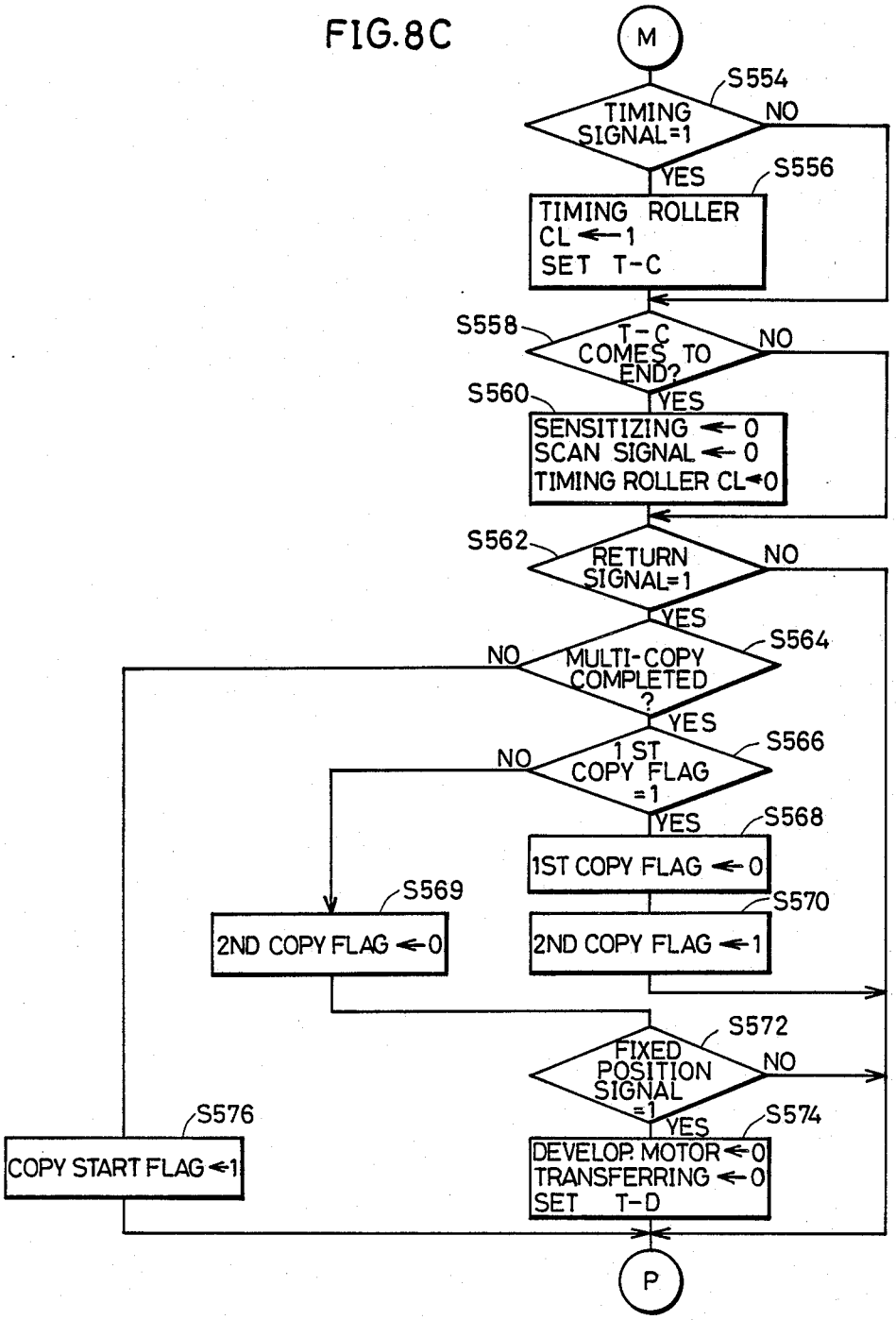
Figure 8D:
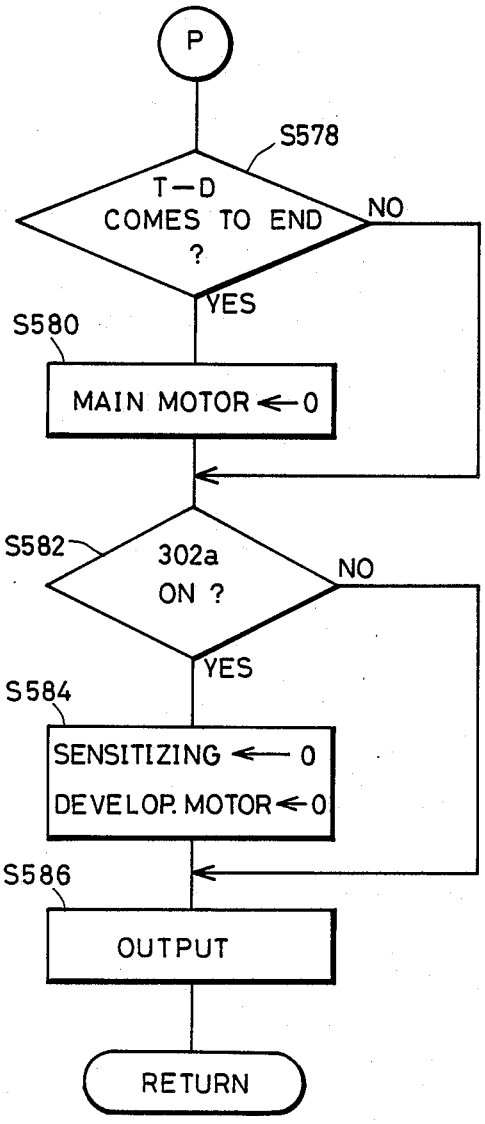

FIG. 7 is a flow chart showing the details of the processing in the step S306 (setting of the second face discharge mode) shown in FIG. 6.

First, in the step S402, the display element LED 302*a* is turned on and the standard feed mode (a mode for discharging sheets of copy paper stored in the intermediate tray 58 without applying a copy process thereto). Then, in the step S404, the display element LED 302*b* is turned on to announce that sheets of copy paper are remaining in the intermediate tray 58.

Subsequently in the step S406, a second reference mode is set in the same manner as in the step S308, except that two conditions, namely, the single-face copy and the A4 size are not set.

FIGS. 8A, 8B, 8C and 8D are flow charts showing the details of the processing of the step S110 (copy operation).

The steps S502 to S508 are related with processing for starting standard copy operation (that is, copy operation in neither the duplex mode nor the composite mode). More specifically, if it is determined in the step S502 that the duplex mode is not selected and it is determined in the step S504 that the composite mode is not selected, a copy start flag is set (in the step S508) when the print key is pressed (in the step S506).

The steps S514 to S520 are related with processing for starting a first copy operation (namely, a copy operation of a first face in the duplex mode or a first copy operation in the composite mode) and a second copy operation (namely, a copy operation of a second face in the duplex mode or a second copy operation in the composite mode). Thus, a copy start flag is set (in the step S516) when the print key is pressed (in the step S514). Additionally, in the first copy operation, when the second copy flag is 0 (in the step S518), a first copy flag is set (in the step S520).

The steps S530 to S532 are related with processing for starting copy operation. More specifically, on condition that the copy start flag is set (in the step S530), the main motor, the developing motor, the sensitizing charger and the transfer charger are turned on. Then, the copy start flag is reset and timers A and B are set.

The steps S534 to S548 are related with processing for selecting and feeding sheets of copy paper.

More specifically, first in the step S534, it is determined whether a second copy flag is set or not. If the second copy flag is set, which means that the second face copy mode or the second copy mode of the composite mode is set, the routine proceeds to the step S540 to select a re-feed roller, whereby sheets of copy paper are fed from the intermediate tray 58.

If it is determined in the step S534 that the second copy flag is not set, the routine proceeds to the step S536 to determine whether the upper storing portion 42 is selected or not. If the upper storing portion 42 is selected, sheets of copy paper are fed from the upper storing portion 42 (in the step S538).

If the upper storing portion 42 is not selected, the routine proceeds to the step S542, so that a second paper feed roller is turned on to feed sheets of copy paper from the lower storing portion 43 on condition that the lower storing portion 43 is selected.

Then, in the step S546, on condition that the timer A comes to an end, a clutch of the paper feed roller is turned off to stop feeding of copy paper (in the step S548).

The steps S550 to S560 are related with processing of copy operation. More specifically, on condition that the timer B comes to an end, a scanning signal for the second MPU 22 is generated to start scanning of the optical system (in the steps S550 and S552). If a timing signal is generated (in the step S554), a timing roller clutch 13 is turned on to start feeding of sheets of copy paper to the photoconductive drum 61 (in the step S556). Further, a timer C is set.

Then, if the timer C comes to an end (in the step S558), the sensitizing charger is turned off, and supply of the scanning signal is stopped and the timing roller clutch is turned off (in the step S560).

The steps S562 to S584 are steps for determining an end of copy operation and a mode for the subsequent operation or the like. More specifically, a return signal is generated (in the step S562) after the scanning of the optical system and when multiple copy operation in a multiple copy mode is completed (in the step S564), it is determined in the step S566 whether the first copy flag is set or not.

If the first copy flag is set, which means that the copy operation just completed is the first copy operation (the first face copy operation in the duplex mode or the first copy operation in the composite mode), the program proceeds to the S568 to reset the first copy flag and to set the second copy flag in the step S570. Thus, the second copy mode is set as the subsequent mode. If it is determined in the step S566 that the first copy flag is not set, the second copy flag is reset in the step S569.

The determination in the step S566 that the first copy flag is not set means that copy operation (standard copy operation or the second copy operation in the duplex mode or the composite mode) is completed. Consequently, on condition that a fixed position signal is generated (in the step S572), the developing motor and the transfer charger are turned off and a timer D is set (in the step S574).

If it is determined in the above described step S564 that multiple copy operation is not completed, the program proceeds to the step S576 to set the copy start flag.

Then, if the timer D comes to an end (in the step S578), the main motor is stopped (in the step S580).

It is determined in the step S582 whether the standard feed mode is selected or not. If the standard feed mode is selected, the sensitizing charger and the developing motor are turned off in the step S584 so that the sheets of copy paper in the intermediate tray 58 are ready to be discharged without being printed.

Then, in the step S586, the sheets are discharged.

In the case of the first copy operation in the duplex mode or the composite mode, a period of aftertreatment in which the main motor is rotated may be made longer taking account of the second copy operation which is always to be performed in this case, so that a period of preparation of the photoconductive member may be shortened when the second copy operation starts immediately after the first copy operation. For this purpose, a set period of the timer D may be made longer for the first copy operation in the duplex or the composite mode.

Thus, the copying apparatus of the embodiment of the present invention operates in the above described manner.

Although the set period of the automatic resetting timer is two minutes after the end of the second copy operation in the above described embodiment, the present invention is not limited thereto. The timer may be set to any period as far as the set period of the timer after the first copy operation is longer than the set period of the timer after the second copy operation.

In addition, although the start point of the set period of the timer after the first copy operation is the time when the first copy operation is completed, the timer may be started again at the time when data is inputted by operation of such keys as a density setting key, a magnification setting key or the like within the set period of the timer after the first copy operation.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A copying apparatus comprising:
image forming means;
means for inputting a plurality of copy conditions;
means for inputting a copy instruction;
means for automatically setting the input plurality of copy conditions selectively to a predetermined state if the subsequent copy instruction is not input within a predetermined period of time after operation of the image forming means; and
time setting means for setting said predetermined period of time suited for the input copy conditions.

2. A copying apparatus comprising:
image forming means;
paper feed means including a first paper feed portion and a second paper feed portion;
sheet receiving means;
means for inputting a plurality of copy conditions;
means for inputting a copy instruction;
copy control means for controlling
a first copy operation responsive to a copy instruction for printing, by said image forming means, a sheet fed from the first paper feed portion under the input copy conditions, thereby to store said sheet in said second paper portion, and
a second copy operation responsive to the subsequent copy instruction after said first copy operation for printing, by said image forming means, a sheet fed from said second paper feed portion under the input copy conditions, thereby to discharge said sheet to said sheet receiving means; and
means for automatically setting the input plurality of copy conditions selectively to a predetermined state by setting
a first group of copy conditions to a predetermined state if a copy instruction for the second copy operation is not input within a first predetermined period of time after the first copy operation, and
a second group of copy conditions to a predetermined state if a copy instruction for the first copy operation is not input within a second predetermined period of time after the second copy operation.

3. A copying apparatus in accordance with claim 2, wherein
said image forming means comprises a first path for guiding a sheet of copy paper to the second paper feed portion with the first face having been printed by the first copy operation, said first face being directed upward, and a second path for guiding the sheet of copy paper with said first face being directed downward.

4. A copying apparatus in accordance with claim 2, wherein
the same face of a sheet of copy paper is printed on by both the first copy operation and the second copy operation.

5. A copying apparatus in accordance with claim 2, wherein
different faces of a sheet of copy paper are printed on by the first copy operation and the second copy operation.

6. A copying apparatus in accordance with claim 2, wherein
said first predetermined period of time is longer than said second predetermined period of time.

7. A copying apparatus in accordance with claim 2, wherein
the number of the first group of copy conditions is smaller than the number of the second group of copy conditions.

8. A copying apparatus in accordance with claim 2, wherein,
if a copy instruction for the second copy operation is not input within said first predetermined period of time after the first copy operation, said means for setting selectively said copy conditions sets a sheet discharge mode for discharging the sheets of copy paper in the second paper feed portion to said sheet receiving means without performing the second copy operation.

9. A copying apparatus comprising:
image forming means;
paper feed means including a first paper feed portion and a second paper feed portion;
means for receiving sheets of copy paper;
means for inputting a plurality of copy conditions;
means for inputting a copy instruction;
copy control means for controlling
a first copy mode for performing an operation responsive to a copy instruction for printing, by said image forming means, a sheet fed from said first paper feed portion under the input copy conditions, thereby to discharge said sheet to said sheet receiving means, and
a second copy mode for performing a first copy operation responsive to a copy instruction for printing, by said image forming means, a sheet fed from said first paper feed portion under the input copy conditions, thereby to store said sheet in said second paper feed portion, and a second copy operation responsive to another copy instruction after said first copy operation for printing, by said image forming means, a sheet fed from said second paper feed portion under the input copy conditions, thereby to discharge said sheet to said sheet receiving means; and
means for automatically setting the input plurality of copy conditions selectively to a predetermined state, by setting the plurality of copy conditions selectively to predetermined states if a copy instruction is not input within a first predetermined period of time after the operation of the first copy mode, or within a second predetermined period of time after the first copy operation of the second copy mode, or within a third predetermined period of time after the second copy operation of the second copy mode.

10. A copy apparatus in accordance with claim 9, wherein said second predetermined period of time is longer than said third predetermined period of time.

11. A copy apparatus in accordance with claim 10, wherein said third predetermined period of time is equal to said first predetermined period of time.

12. A copy apparatus comprising:

image forming means;

paper feed means for feeding sheets of copy paper to said image forming means;

sheet receiving means for receiving the sheets of copy paper printed by said image forming means;

sheet transport means for sending the printed sheets selectively to said paper feed means or to said sheet receiving means;

manual input means for manually inputting a plurality of copy conditions;

means for inputting a copy instruction;

copy control means including a first control means and a second control means, said first control means being responsive to a copy instruction for printing, by said image forming means, a sheet of copy paper fed from said paper feed means under the input copy conditions, and sending said sheet to said sheet receiving means, and said second control means being responsive to a copy instruction for printing, by said image forming means, a sheet of copy paper fed from said paper feed means under the input copy conditions, and sending said sheet to said paper feed means;

a first timer set at the end of the copy operation by said first control means;

a second timer set at the end of the copy operation by said second control means, a set period of time of said second timer being longer than a set period of time of said first timer; and means for automatically setting the input plurality of copy conditions selectively to a predetermined state, by setting a first group of copy conditions to a predetermined state if a copy instruction is not input within the set period of time of said first timer, or a second group of copy conditions to a predetermined state if a copy instruction is not input within the set period of time of said second timer.

13. A copying apparatus in accordance with claim 12, wherein said first group of copy conditions include the number of sheets to be printed and a magnification.

14. A copying apparatus in accordance with claim 12, wherein said second group of copy conditions include forbidding an operation of said image forming means.

15. A copying apparatus in accordance with claim 14, wherein said second group of copy conditions further include the number of sheets to be printed and a magnification.

16. A copying apparatus comprising:

image forming means including a photoconductive member;

paper feed means for feeding sheet of copy paper to said image forming means;

sheet receiving means for receiving sheets of copy paper printed by said image forming means;

sheet transport means for sending the printed sheets of copy paper selectively to said paper feed means or to said sheet receiving means;

manual input means for manually inputting a plurality of copy conditions;

means for inputting a copy instruction;

copy control means including a first control means and a second control means, said first control means being responsive to a copy instruction for printing, by said image forming means, a sheet of copy paper fed from said paper feed means under the input copy conditions, and sending said sheet to said sheet receiving means, and said second control means being responsive to a copy instruction for printing, by said image forming means, a sheet of copy paper fed from said paper feed means under the input copy conditions, and sending said sheet to said paper feed means;

a first timer set at the end of the copy operations by said first control means;

a second timer set at the end of the copy operation by said second control means, a set period of time of said second timer being longer than a set period of time of said first timer; and means for applying aftertreatment to said photoconductive member to cause a surface potential of said photoconductive member to be uniform during operation of said first timer of said second timer.

17. A copying apparatus comprising:

image forming means including a photoconductive member;

means for inputting a plurality of copy conditions;

means for applying aftertreatment to said photoconductive member to cause a surface potential of said photoconductive member to be uniform within a predetermined period of time after operation of said image forming means; and a variable time setting means for setting said predetermined period of time out of a plurality of possible times, the set time being suited for the specific input copy conditions.

18. A copy apparatus comprising:

image forming means including a photoconductive member;

paper feed means including a first paper feed portion and a second paper feed portion;

means for receiving a sheet of copy paper;

means for inputting a plurality of copy conditions;

means for inputting a copy instruction;

copy control means for controlling a first copy mode for performing an operation responsive to a copy instruction for printing, by said image forming means, a sheet of copy paper fed from said first paper feed portion under the input copy conditions, thereby to discharge said sheet to said sheet receiving means, and a second copy mode for performing a first copy operation responsive to a copy instruction for printing, by said image forming means, a sheet fed from said first paper feed portion, thereby to store said sheet in said second paper feed portion, and a second copy operation responsive to another copy instruction after said first copy operation for printing, by said image forming means, a sheet fed from said second paper feed portion under the input copy conditions, thereby to discharge said sheet to said sheet receiving means;

means for applying aftertreatment to said photoconductive member to cause a surface potential of said photoconductive member to be uniform within a predetermined period of time after operation of said image forming means; and a variable time setting means for setting said predetermined period of time out of a plurality of possible times, the set time being suited for the specific input copy conditions.

19. A copying apparatus having the capability of producing single or double-sided copies, comprising:

means for receiving an image;

means for forming an image indicative of the image received by the receiving means;

means for inputting a plurality of copy conditions to the copying apparatus;

means for inputting copy instructions, said copy instructions functioning together with the copy conditions to control the copying operation of the copying apparatus;

means for automatically setting the input plurality of copy conditions selectively to a predetermined state if the subsequent copy instruction is not input within a predetermined period of time after operation of the image forming means;

a variable time setting means for setting said predetermined period of time out of a plurality of possible times, the set time being suited for the specific input copy conditions; and plurality of paper feeding means, said plurality including means for feeding paper of a first size, means for feeding paper of a second size, and means for feeding paper of either the first or second size which has already had an image formed on one side from the image forming means.

20. The copying apparatus of claim 19, further comprising:

means for forming an image on one side of paper having either the first or second size during a first copy operation and then forming an image on the other side of said piece of paper during a second copy operation;

means for receiving sheets of paper on which an image has been formed by the image forming means; and means for discharging sheets of paper to the receiving means if a copy instruction for the second copy operation is not input within a first predetermined period of time after the first copy operation, said means for inputting said copy conditions set a sheet discharge mode for discharging the sheets of copy paper in the feeding paper of either a first or second size means to said sheet receiving means without performing the second copy operation.

* * * * *